US005911763A

United States Patent [19]

Quesada

[11] Patent Number: 5,911,763

[45] Date of Patent: Jun. 15, 1999

[54] THREE POINT LOCK MECHANISM

[76] Inventor: Flavio R. Quesada, 6001 SW. 92nd Ct., Miami, Fla. 33173

[21] Appl. No.: 09/005,593

[22] Filed: Jan. 12, 1998

[51] Int. Cl.[6] ..... E05B 63/14

[52] U.S. Cl. ..... 70/120; 70/108; 292/36

[58] Field of Search ..... 70/108, 109, 120; 292/34, 36, 37, 40

[56] References Cited

U.S. PATENT DOCUMENTS

| | | | |
|---|---|---|---|
| 1,046,438 | 12/1912 | Caldwell | 70/120 X |
| 1,387,573 | 8/1921 | Wilson | 292/36 |
| 2,041,099 | 5/1936 | Williams | 292/36 X |
| 2,628,117 | 2/1953 | Robinson | 292/36 X |
| 2,650,388 | 9/1953 | White | 292/36 X |
| 3,670,537 | 6/1972 | Horgan, Jr. | 70/120 |
| 3,778,079 | 12/1973 | Vornberger et al. | 292/36 X |
| 4,015,866 | 4/1977 | Marsh et al. | 292/36 |
| 4,154,070 | 5/1979 | Bahry et al. | 70/108 |
| 4,306,432 | 12/1981 | Ravid | 70/120 |
| 4,362,034 | 12/1982 | Amgar | 70/120 X |
| 4,362,328 | 12/1982 | Tacheny et al. | 292/36 |
| 4,468,943 | 9/1984 | Beattie et al. | 292/36 X |
| 4,470,277 | 9/1984 | Uyeda | 292/36 X |
| 5,077,992 | 1/1992 | Su | 70/107 |
| 5,110,164 | 5/1992 | Whiteman et al. | 292/4 |
| 5,244,238 | 9/1993 | Lindquist | 292/36 X |
| 5,472,246 | 12/1995 | Puric | 292/36 |
| 5,498,038 | 3/1996 | Simon et al. | 292/36 |
| 5,595,076 | 1/1997 | Weinerman et al. | 70/208 |
| 5,603,234 | 2/1997 | Lozier et al. | 70/119 |

FOREIGN PATENT DOCUMENTS

| | | | |
|---|---|---|---|
| 427563 | 11/1947 | Italy | 70/120 |
| 276634 | 5/1928 | United Kingdom . | |
| 1563393 | 3/1980 | United Kingdom . | |

*Primary Examiner*—Suzanne Dino Barrett
*Attorney, Agent, or Firm*—Richard C. Litman

[57] ABSTRACT

A three point lock mechanism includes a lower deadbolt which respectively engage the threshold and lintel of a door or other hinged panel, in addition to the central jamb deadbolt. The mechanism utilizes a conventional deadbolt lock set for the central jamb deadbolt, with a generally circular plate being attached to the lock set to rotate therewith when the lock is turned to lock or unlock the door. An upper and a lower deadbolt actuation rod extend from the plate, and serve to actuate respectively the upper and lower deadbolts of the system by a pivoting actuator at each deadbolt. The two rods are pivotally secured to the plate 135 degrees from one another, in order to provide an overcenter weight bias of the rods to urge the upper and lower deadbolts to a retracted position when retracted, and to an extended position when extended. The rods are each secured to the plate at a different radius from the center of the plate, in order to provide equal linear travel distances for the rods and deadbolts due to the different arcuate positions of the rod attachment points. The present three point lock mechanism provides greater security for a door or panel being secured thereby, and also meets standards for hurricane resistant structures, thus precluding any requirement for additional shutters for a door or panel being secured by the present mechanism.

18 Claims, 3 Drawing Sheets

THREE POINT LOCK MECHANISM

BACKGROUND OF THE INVENTION

1. Field of the Invention

The present invention relates generally to latching and locking devices, and more specifically to a locking mechanism providing three simultaneously actuated deadbolts from a single lock and key operation. The bolts engage the threshold, lintel, and adjacent frame or jamb at three widely separated points about the door.

2. Description of the Related Art

Conventional sliding (striker plate) latches and deadbolt latches engage the adjacent edge of the door frame or jamb, at only a single point adjacent the latch mechanism in the door. While this provides convenience and economical installation, it has become increasingly necessary to provide additional security over and above that provided by a single deadbolt or other latch bolt engaging the adjacent frame at only a single point. This is not only true for protection against unauthorized entry, but also for security against adverse weather conditions. A conventional single point latch bolt cannot provide the required strength and security in many areas of the country, where hurricanes occur on a semi-regular basis.

In these areas, very strict regulations describe the security required for a door. For example, in Florida a door must pass the test of having a length of 2×4 lumber propelled against the door at 34 mph, twice. The door and latch mechanism must then pass an operational cycle test.

Generally, the strength and security required cannot be met by a single deadbolt lock or latch, or even by additional pins driven into receptacles in the threshold and lintel of the door by a common lock or latch mechanism. Accordingly, such doors are required to have shutters, which adds considerably to the cost of installing and maintaining such doors. Also, the linear travel of the supplementary latch rods of existing multiple point latches or locking mechanisms, generally differ between each pin or bolt, due to the translation of motion from an arcuate direction (rotating the lock mechanism within the door) to a linear direction (to drive the bolts or pins). In addition, such bolts or pins comprising elongate rods are not particularly secure, due to the flexure which may occur in the rods, and also due to the lack of a consistent overcenter action in both directions for all bolts or pins, in order to assure that the bolts or pins will remain in the selected position.

Accordingly, a need will be seen for a three point latch mechanism which may be installed in a conventionally hinged door having a threshold, lintel, and adjacent frame or jamb. (The adjacent frame may comprise the edge of an adjacent door.) The latch bolts themselves are deadbolts having an overcenter mechanism therein, for holding the bolts in the desired retracted or extended position. A specially configured plate is secured to the central lock mechanism for the door, with a linear actuating rod extending from the plate to each of the deadbolts. The plate is specially configured to drive each of the actuating rods the same distance for a given amount of rotation of the plate. The actuating rods manipulate a lever extending from each of the deadbolts, to drive the deadbolt to an extended or retracted position, as desired. A discussion of the related art of which the present inventor is aware, and its differences and distinctions from the present invention, is provided below.

U.S. Pat. No. 4,306,432 issued on Dec. 22, 1981 to Eliezer Ravid describes a Door Lock having a series of latch bars or pins which are driven directly from a generally circular plate within the door cavity. The plate in turn is rotated by a series of levers, which in turn are actuated by a cam from a lock cylinder. A series of arcuate slots are provided in the plate, with the ends of the latch rods being secured to the slots by pins which slide in the slots as the plate is turned. Thus, the purely rotary motion of the plate is converted to purely linear motion of the latch rods. In the present mechanism, the actuating rods are not slidably affixed to the plate; the rod ends move only pivotally relative to their respective fixed locations on the plate. Also, the present invention uses the actuating rods to operate deadbolts, rather than having the actuating rods themselves serve as the bolts or pins, thus providing a much more secure mechanism.

U.S. Pat. No. 4,362,328 issued on Dec. 7, 1982 to John C. Tacheny et al. describes a Patio Door Lock having opposite upper and lower actuator rods which are selectively driven into receptacles in the threshold and lintel of the door. Each of the rods terminates in a pin which is directly affixed to the end of each rod, unlike the separate actuator rods of the present lock mechanism which actuate separate dead bolts. While the present mechanism provides the desired over center action to hold the bolts in an extended or retracted position as desired without need of springs, Tacheny et al. require springs urging the rods to a withdrawn position. Also, Tacheny et al. utilize a relatively complex linkage to drive their actuator rods, rather than a single rotary plate, as used in the present mechanism.

U.S. Pat. No. 5,077,992 issued on Jan. 7, 1992 to Frank Su describes a Door Lock Set With Simultaneously Retractable Deadbolt And Latch. The mechanism is adapted for use from the room side of a door, for a user to retract simultaneously an extended deadbolt and the conventional tapered latch bolt which engages a striker plate, by actuating a single lever. A lever driven by the latch bolt engages a slot in a cam on the deadbolt mechanism. When the deadbolt is extended and the latch bolt mechanism is actuated from inside the room, the lever is moved, thereby causing the deadbolt to be retracted also. No plural actuation rods are disclosed for driving plural deadbolts at opposite ends of the door, as provided by the present invention, nor is any rotary plate provided by Su for such actuation.

U.S. Pat. No. 5,110,164 issued on May 5, 1992 to Paul I. Whiteman et al. describes a Latching Apparatus For A Panel Door, having an upper and opposite lower rod and latch mechanism. The two rods are telescoped together from the actuating mechanism, with the upper rod being movable in rotation but not linearly, and the lower rod being linearly movable but not movable in rotation. Selective movement of the actuating mechanism and handle, actuates either the upper or the lower rod to engage or disengage its respective latch, as desired. The present mechanism drives two opposed actuating rods linearly to operate their respective deadbolts, while simultaneously operating the medial deadbolt associated with the lock or latch mechanism. No simultaneous linear actuation is disclosed by Whiteman et al.

U.S. Pat. No. 5,472,246 issued on Dec. 5, 1995 to Marino Puric describes an Independent Dual Deadbolt Locking Mechanism. The two bolts are actually only independent in that the disabling of one bolt does not affect the other bolt in the mechanism. The two deadbolts are somewhat modified from the conventional, in order to provide the desired operation. Puric uses a lever having two generally opposed arms, which rotates to operate one of the bolts with each arm. Puric also uses a spring to bias the second (upper) deadbolt toward the first deadbolt, i.e., in a retracted direction. In contrast, the present mechanism biases each of the deadbolts in the desired position (toward the extended position when extended, toward the retracted position when retracted), by means of the specific positioning of the actuators.

U.S. Pat. No. 5,498,038 issued on Mar. 12, 1996 to Ira J. Simon et al. describes a Multi-Point Door Lock System, wherein a single mechanism simultaneously drives a plurality of bolts to an extended or retracted condition. However, no deadbolts are disclosed, as used in the present invention. Rather, Simon et al. provide a series of linearly adjustable rods, with each of the rods having a latch bolt directly secured to the distal end thereof. The mechanism also requires a plurality of springs within the central mechanism, which springs are not required by the present mechanism. No overcenter action biasing the bolts (or rods) to a locked position when they are locked, or to an unlocked position when they are unlocked, is disclosed by Simon et al, as provided by the present invention.

U.S. Pat. No. 5,595,076 issued on Jan. 21, 1997 to Lee S. Weinerman et al. describes a Handle Operable Two Point Latch And Lock, wherein a central mechanism drives opposite latch pull rods to release opposite bolts in a door. The Weinerman et al. mechanism does not apply an extending action to the two opposite bolts, as is the case in the present invention. Rather, the two bolts of the Weinerman et al. device are spring biased to an extended position, and the actuating rods serve only to retract the bolts. Also, the actuating rods are secured directly to the bolts, rather than actuating a pivotal linkage to the deadbolts, as in the present invention. In addition, Weinerman et al. do not disclose any form of over center action in their mechanism, which would urge the bolts to remain in a retracted position when they are retracted.

U.S. Pat. No. 5,603,234 issued on Feb. 18, 1997 to Benjamin F. Lozier et al. describes a Multiple Lock Assembly having three locks which are selectively operable to actuate a series of bolts extending from a single bar. This mechanism is essentially opposite that of the present invention, where a single lock mechanism operates three bolts via three different linkages. The Lozier et al. mechanism is adapted for use in bank vault doors and the like, with all of the bolts being immovably affixed to a single bar, and being driven in the same direction by the movement of the single bar. No overcenter action is disclosed by Lozier et al., to urge the bolts to an extended or locked position when they are locked, and to urge them to a retracted position when unlocked, as in the present invention.

British Patent Publication No. 276,634 accepted on May 10, 1928 to Paul De Lapparent describes a Safety Fastening Device comprising a series of interengaging concentric pins in a double door. The lowermost pin of one door engages the next pin in line in the opposite door, to raise it to engage the next pin of the first door, etc., until the uppermost pin is seated in the door lintel. Thus, the two doors are securely fastened together by means of the interlocking pins, but only a single pin is securing the two doors at the lintel, unlike the multiple bolts of the present mechanism. Also, De Lapparent does not disclose any overcenter action to urge the pins to remain in an engaged position when they are engaged, and to urge them to a retracted position when they are retracted, as provided by the present invention.

Finally, British Patent Publication No. 1,563,393 published on Mar. 26, 1980 to William S. Astbury describes Door Fasteners in which a lock is provided on one side, with a latch handle on the opposite side allowing the door to be opened regardless of whether the opposite side lock is locked or not. The mechanism drives a central bolt and upper and lower rods which extend into the threshold and lintel of the door opening. However, the central bolt and the rods are direct acting, and do not activate separate deadbolts by means of pivotal actuating mechanisms at each deadbolt, as in the present invention. Moreover, Astbury does not disclose any overcenter action to urge the latch rods and pins to remain in an extended position when they are extended, and to urge them to a retracted position when they are retracted, as provided by the present invention.

None of the above inventions and patents, either singly or in combination, is seen to describe the instant invention as claimed.

SUMMARY OF THE INVENTION

The present invention comprises a three point lock mechanism for securing a door or the like at three different points about its periphery, i. e., at the threshold, jamb (or to another door or panel), and lintel. A single, central lock mechanism simultaneously actuates a central deadbolt and two generally vertical, oppositely extending rods within the door panel. The two rods in turn actuate a lower and an upper deadbolt, to secure the door or panel at one lateral edge, the lower edge, and upper edge.

Each deadbolt is actuated (extended or retracted) by means of a pivot arm extending therefrom, which drives the bolt to an extended or retracted position as desired. The pivot arms of the upper and lower bolts are in turn actuated by the respective pushrods from the central mechanism. The deadbolt mechanisms may be conventional, including means for biasing or urging the bolts to remain in a retracted position when they are retracted, and to remain in an extended position when they are extended.

The central mechanism includes a generally circular plate which is attached to the central lockset and deadbolt, and from which the upper and lower rods extend. The plate and attachment ends of the rods are particularly configured to provide identical travel distances for each of the rods and deadbolts, when the lock or latch mechanism is manipulated from a locked to an unlocked (or unlocked to locked) position. The placement of the attachment ends of the rods about the plate, and their weights, also serve to hold the arrangement in an unlocked position once the bolts have been retracted, and to hold the assembly in a locked position when the bolts have been extended.

The present three point lock mechanism is useful in many different types of openable, hinged panels, but is particularly valuable in securing and locking either single or double door sets. The present three point lock mechanism provides sufficient strength and rigidity to pass tests for hurricane resistant structures, thereby precluding need for additional reinforcement (shutters, etc.).

Accordingly, it is a principal object of the invention to provide an improved three point lock mechanism for actuating deadbolts located at the threshold, lateral frame or jamb, and lintel of a door or other movable panel.

It is another object of the invention to provide an improved three point lock mechanism utilizing a central plate secured to a conventional deadbolt lock mechanism, which plate rotates with rotation of the lock mechanism to actuate upper and lower deadbolts.

It is a further object of the invention to provide an improved three point lock mechanism utilizing an upper and a lower rod element, each connected to the central plate and each having a distal end connected to an actuating pivot on the respective deadbolt.

An additional object of the invention is to provide an improved three point lock mechanism in which the central plate provides an equal linear throw for each of the rods connected thereto, to provide equal actuation distances for each deadbolt.

Still another object of the invention is to provide an improved three point lock mechanism which provides an overcenter action, urging at least the upper and lower deadbolts to a retracted position when retracted, and to an extended position when extended.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
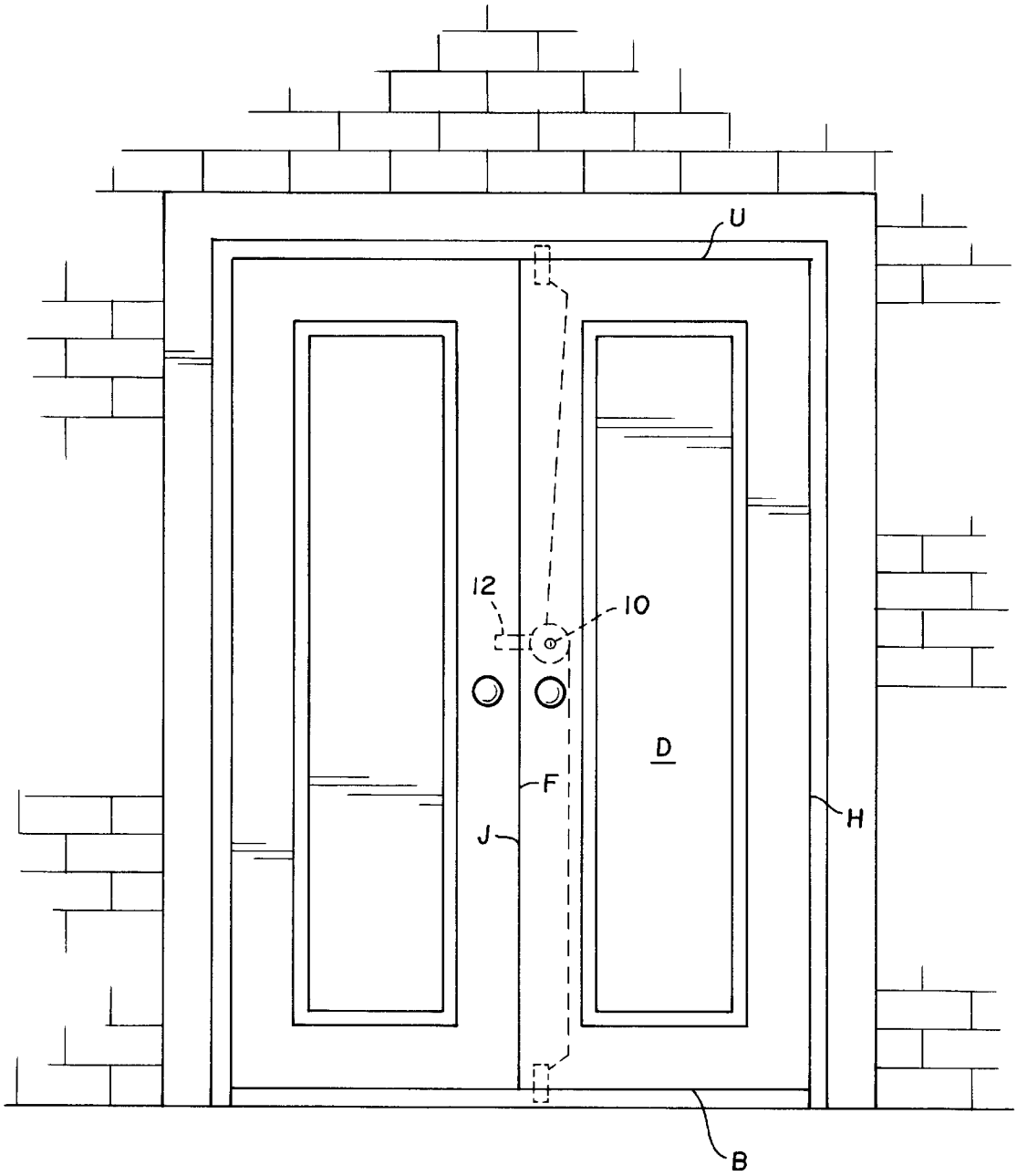
FIG. 1 is an environmental elevation view, showing the general disposition of the present three point lock mechanism in a typical installation.

The present invention comprises a three point lock mechanism for hinged panels, such as doors and the like, and provides three separate points for securing the panel to the adjacent structure. FIG. 1 provides a general view of the present invention, installed within a door D having an upper or lintel edge U, an opposite bottom or threshold edge B, a hinge attachment edge H, and a jamb edge J opposite the hinge attachment edge H. A conventional deadbolt lock set 10 is installed within the interior of the door D, adjacent the jamb edge J and generally medially therealong. The lock set 10 serves to actuate a first or central jamb deadbolt 12, which selectively engages a cooperating receptacle in the door jamb or frame F (or in an adjoining door of a double door set, as shown in FIG. 1).

Figure 2:
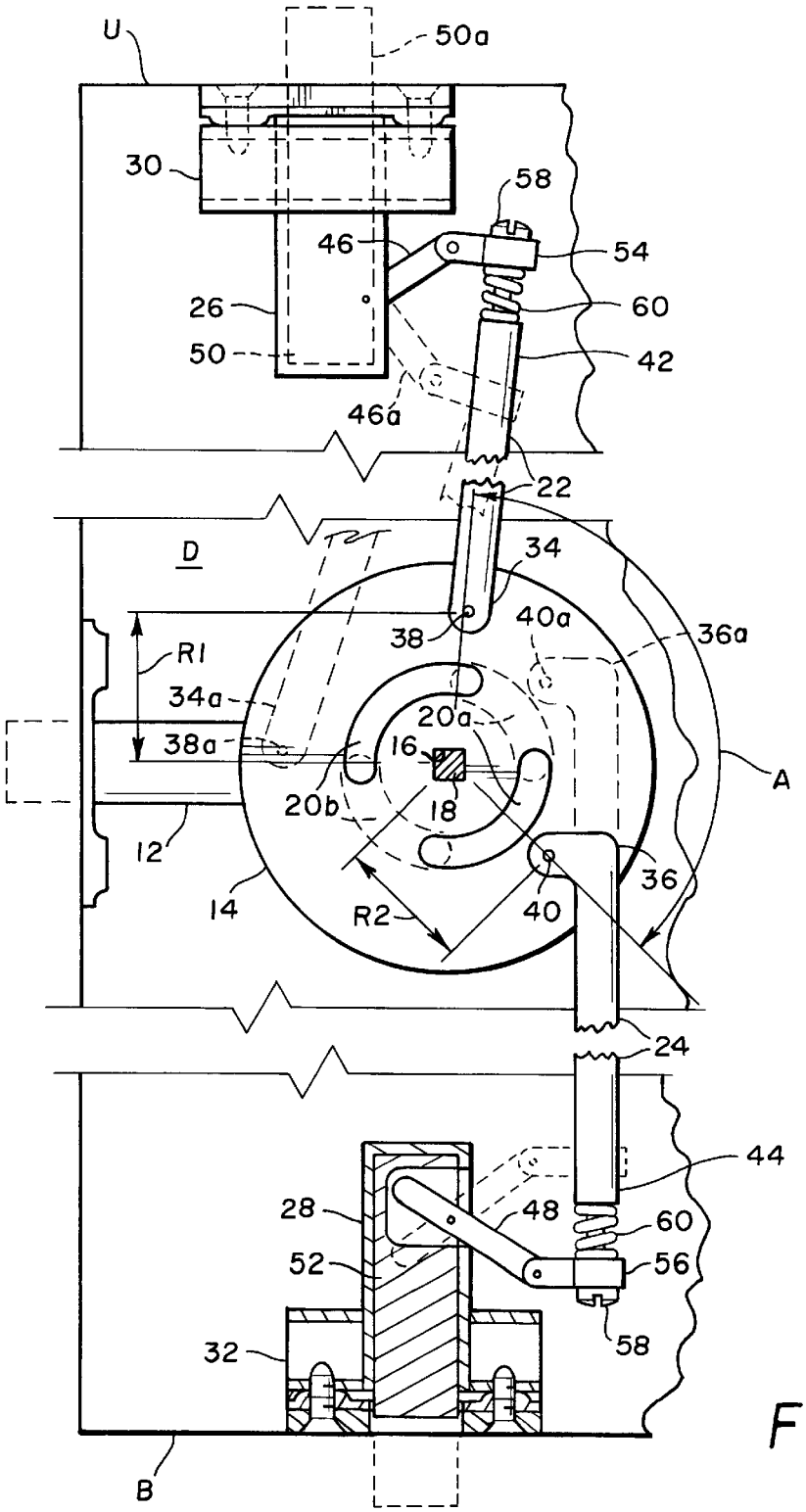
FIG. 2 a front elevation view in section of the present three point lock mechanism, showing the central plate and actuating rods and their connections to the upper and lower deadbolts, with the extended positions of all components being shown in broken lines.

The present invention includes a generally circular rotary actuator plate 14, having a center with a passage 16 therethrough adapted for keying to the rotary shaft 18 of the deadbolt lock set 10, as shown more clearly in FIG. 2 of the drawings. Thus, when the rotary shaft 18 of the lock set 10 is turned about its rotary axis (defined by the shaft 18), as in locking or unlocking the door or panel D, the rotary plate 14 turns in unison with the lock set shaft 18. (A pair of arcuate lock set structure clearance slots 20*a* and 20*b* is provided in the plate 14, to preclude any interference between the plate 14 and the adjacent structure of the lock set, e. g., screw heads, etc.).

An upper and an opposite lower deadbolt actuating rod, respectively 22 and 24, extend from the actuator plate 14 respectively to an upper or lintel deadbolt assembly 26 and an opposite bottom or threshold deadbolt assembly 28, installed in respective housings 30 and 32 adjacent the upper or lintel edge U and opposite bottom or threshold edge B of the door or panel D. Each actuating rod 22 and 24 includes a plate connecting end, respectively 34 and 36, which is pivotally affixed to an actuating rod attachment point or pin, respectively 38 and 40, on the actuator plate 14. Each actuating rod 22 and 24 includes an opposite, distal end, respectively 42 and 44, which attaches respectively to an upper and a lower deadbolt pivotal actuating arm, respectively 46 and 48, extending from the respective upper and lower deadbolt assemblies 26 and 28.

The deadbolt assemblies 26 and 28 are conventional, in that each contains a deadbolt, respectively 50 and 52, which extends and retracts linearly within their respective assemblies. The extension and retraction means may be a pivoting arm or toggle, such as the arms 46 and 48 for the respective upper and lower deadbolt assemblies 26 and 28, or other means known in the art. U.S. Pat. No. 5,472,246 to Puric, discussed in the discussion of the related art further above, discloses an essentially conventional deadbolt mechanism using a pivoting arm or linkage to actuate the bolt. The novelty of the present invention lies not in the deadbolt mechanisms per se, but rather in the means used to provide simultaneous and uniform actuation of such mechanisms.

It will be seen that the actual attachment points 50 and 52 of the respective rods 22 and 24 with the upper and lower pivotal arms 46 and 48 is by means of adjustable links, respectively 54 and 56. Each of the adjustable links 54 and 56 includes a screw 58 which is threaded coaxially into the distal end 42 and 44 of each actuation rod 22 and 24. Each link 54 and 56 is captured between the head of the screw 58 and a spring 60, which serves to hold the desired position for the adjustment assembly. These adjustment links 54 and 56 allow the length of each actuation rod 22 and 24 to be adjusted precisely, for providing the precise length required for each rod 22 and 24 to actuate the respective deadbolt actuation arms 46 and 46 through their complete range of travel to extend and retract the upper and lower deadbolts 50 and 52 completely.

While the above described rod length adjustment means 54 and 56 serve to adjust precisely the overall length of each actuation rod 22 and 24, thus adjusting for minor variations in the size of the door or panel D, it will be seen that the adjustment means 54 and 56 do nothing to adjust the total travel distance of the rods 22 and 24 between the locked and unlocked positions of the deadbolts 50 and 52, as this is controlled by the arcuate motion of the rotary plate 14 and the radial distances of the upper and lower rod attachment points 38 and 40. However, the novel configuration of the actuator plate 14, and the specific attachment positions of the two arms 22 and 24 thereto, provide the precise amount of travel required to extend and retract the upper and lower deadbolts 50 and 52 completely, as described below.

It will be noted that FIG. 2 actually shows two different positions for the plate 14 and attached components, with the unlocked position being shown in solid lines and the locked position being shown in broken lines. When the plate 14 is in its unlocked position, it will be seen that the upper rod attachment point 38 is positioned substantially directly vertically above the center of the plate 14 and the lockset shaft 18. The lower rod attachment point 40 is located 135 degrees clockwise about the plate 14 (as shown in FIG. 2), or down and to the right from the center hole 16 and shaft 18, as shown by the arcuate displacement angle A in FIG. 2.

Thus, when the assembly is in the unlocked position, with the upper rod 22 raised and the lower rod 24 lowered to retract the two deadbolts 50 and 52 by means of the arcuate arms or toggles 46 and 48, the upper rod 22 will be substantially centered above the center 16 of the plate 14, with no appreciable lateral offset. In this position, the weight of the rod 22 is acting essentially straight through the center 16 of the plate 14, with no horizontal offset or arm to create a rotational moment about the shaft 18, to urge it in either a locked or unlocked direction of rotation.

Figure 3:
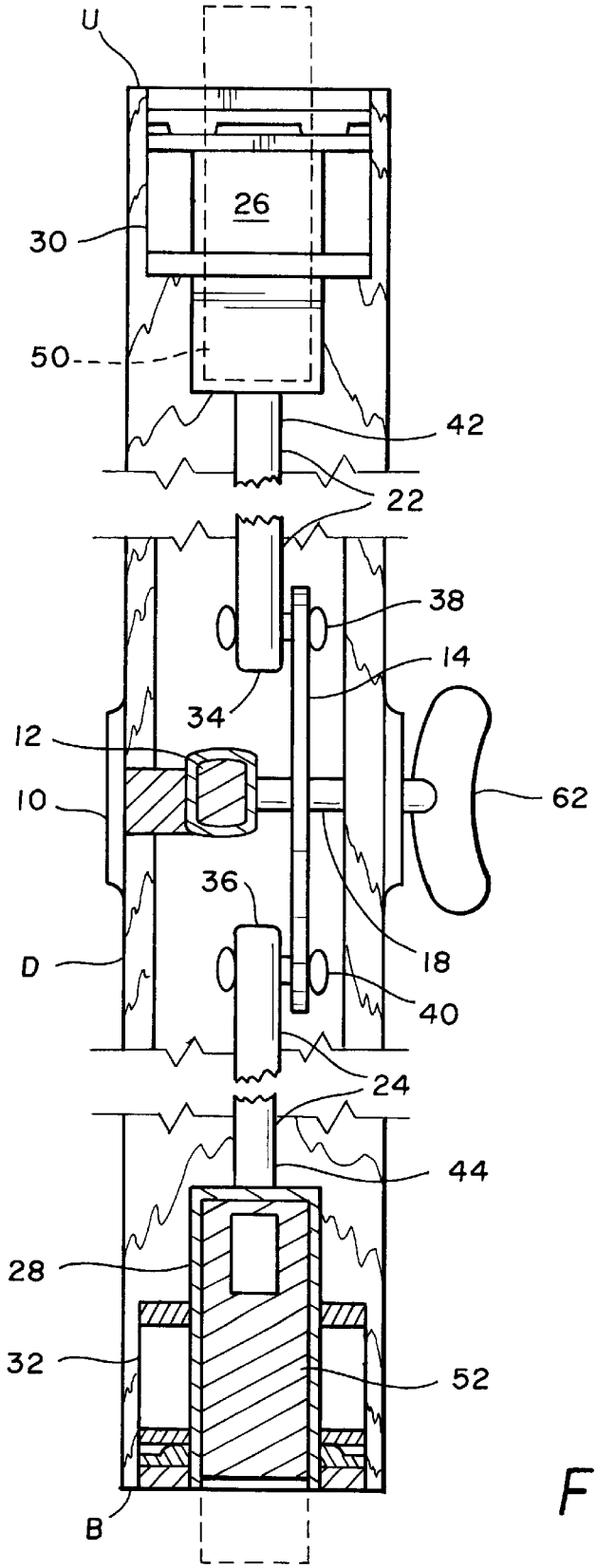
FIG. 3 is a side elevation view in section of the mechanism of FIG. 2, showing further details.

However, the lower arm 24 is suspended from a point 40 below and laterally offset from the center 16 of the plate 14. This lateral offset defines a horizontal moment arm, which when multiplied by the weight of the rod 24, produces a clockwise moment (as seen in FIG. 2) which urges the plate 14 in a clockwise rotary direction, i. e., in the direction of rotation for unlocking the lock set 10 and upper and lower deadbolts 50 and 52. Thus, when the present three point lock mechanism is turned to an unlocked position, as shown by the solid line positions of the components of FIG. 2, the relative positions of the two actuating rods 22 and 24 result in a net force moment which urges the plate 14 to rotate toward and remain in an unlocked position, to hold the various components in the unlocked position until the plate 14 is positively rotated from the unlocked position by means of a key or thumbturn 62 (shown in FIG. 3) acting on the lock set 10.

When the lockset 10 and attached rotary actuator plate 14 are turned 90 degrees counterclockwise (as seen in FIG. 2) to a locked position, it will be seen that the upper rod attachment point 38 is rotated to a position 38*a* (shown in broken lines in FIG. 2) which is generally horizontally offset to the left of the plate center 16 and shaft 18. This draws the upper rod 22 downwardly from its highest or unlocked position, thereby pivoting the upper deadbolt actuating arm 46 downward to a locked position 46*a,* causing the upper deadbolt 50 to extend to a locked position 50*a*. It will be seen that this locked position 38*a* for the upper rod attachment point also offsets the upper rod plate attachment end 34 generally horizontally from the plate center 16 and shaft 18 to a locked position 34*a,* thus producing a moment acting to urge the plate 14 to rotate further counterclockwise, thereby tending to hold the present three point lock mechanism in a locked position when it is turned to a locked position.

As the plate 14 is only turned 90 degrees between its unlocked and locked positions, it will be seen that the lower rod attachment point 40 and lower rod attachment end 36, will be rotated to a locked position 40*a* and 36*a* which is up and to the right of the plate center 16 and shaft 18. This results in a clockwise moment, due to the horizontal arm component of the offset to the right of center, of the rod attachment end 40*a* and its weight acting thereabove. However, two factors are involved here, to produce a clockwise (or unlocking direction) moment which is smaller than the counterclockwise (or locking direction) moment produced by the upper rod 22 and its locked position attachment point 38*a.*

First, it will be seen that the radius R1 of the upper rod attachment point 38/38*a,* is longer than the radius R2 of the lower rod attachment point 40/40*a*. This results in a longer arm, and therefore a greater moment, urging the plate 14 to the locked position when the plate 14 is rotated to the locked position, placing the upper rod attachment end 34*a* at position 38*a.*

Second, the effective moment arm of the lower actuating rod attachment point 40*a* in the locked position, is shortened due to the displacement of the attachment point 40*a* from the horizontal. This 45 degree displacement results in an effective arm equal to the sine of 45 degrees, or approximately 71 percent of the moment which would be developed by an arm of the same length in a purely horizontal displacement. These two factors result in a net counterclockwise rotational moment for the present lock mechanism, thus further urging it to a locked position when in a locked position.

The above described arm or rod attachment locations 38/38*a* and 40/40*a* to the plate 14, also serve to provide substantially equal distances or lengths of vertical motion for the two arms or rods 22 and 24. As noted above, the lower rod attachment point radius R2 is significantly shorter than the upper rod attachment point radius R1. However, the rotation of the lower arm attachment point between its unlocked position 40 and locked position 40*a,* results in the point rotating counterclockwise from a position 135 degrees from the vertical centerline of the plate 14, to a position only 45 degrees from the plate 14 vertical centerline. The distance traveled from either the unlocked position 40 or the locked position 40*a,* to an intermediate horizontal position, is defined by the radius R2 of the point 40/40*a* multiplied by the sine of 45 degrees, or approximately 71 percent of the radius R2, as described above. However, since the total arcuate distance traveled by the lower arm attachment point between its unlocked position 40 and locked position 40*a* is 90 degrees, the total vertical linear displacement is twice the sine of 45 degrees multiplied by the radius R2, or approximately 1.414 times the radius R2.

On the other hand, the vertical linear travel of the upper arm or rod attachment point between its unlocked position 38 and its locked position 38*a,* is obviously equal to the attachment point 38/38*a* radius R1. If the two radii R1 and R2 were equal, it will be seen that the lower actuator arm or rod 24 would move 1.414 times as far as the upper actuator arm or rod 22.

In order to preclude any requirement for modification of the deadbolt assemblies 26 and 28, e. g., shortening the actuating arm 48 of the lower deadbolt assembly 28 in order to compensate for the longer travel of the lower actuating rod 24 if the two radii R1 and R2 were the same, the lower rod attachment point radius R2 is shorter than the upper rod attachment point radius R1. By making the radius R2 equal to the sine of 45 degrees multiplied by the length of the radius R1, or approximately 71 percent of the length of radius R1, the vertical distance subtended by the two deadbolt rod attachment points between their unlocked positions 38 and 40, and their locked positions 38*a* and 40*a,* will be essentially equal to one another, thus resulting in essentially equal amounts of vertical travel at the distal ends 42 and 44 of the two deadbolt actuating rods 22 and 24, thereby actuating both the upper and lower deadbolt assemblies 26 and 28 to an equal degree. (The plate attachment end 36 of the lower rod 24 may be offset, as shown in FIG. 2, to provide any required clearance from other components.)

In summary, the present three point lock mechanism provides a much needed means of securing doors and other lockable hinged panels along all three edges not secured by one or more hinges. The use of three deadbolt assemblies, rather than merely using rods or pins actuated directly from a central linkage, provides far greater security for the door or panel using the present mechanism.

The rotary plate serving as the heart of the present mechanism, serves to provide equal ranges of travel for the upper and lower actuating rods of the mechanism, thereby providing for equal actuation of the upper and lower deadbolt assemblies without requiring any modification thereto. Also, the attachment points for the two actuating rods on the rotary plate, result in net moments being achieved which tend to urge the mechanism to an unlocked position, or retain it in an unlocked position, when in an unlocked position, and to urge the mechanism to a locked position, or retain it in a locked position, when in a locked position, thereby providing even greater security for a door or panel using the present mechanism. The plate is preferably formed of a durable and tamper resistant material, such as non-magnetic, corrosion resistant (stainless) steel, for further durability and longevity.

While the present three point lock mechanism adds considerable security to any door or panel so equipped, it is particularly valuable in areas where hurricanes occur with any regularity, and serves to meet or exceed the requirements for hurricane resistant doors or panels when installed therein, thus obviating any further requirement for shutters and/or other protective measures. Thus, the present three point lock mechanism is of value in virtually any exterior door or panel installation, but will prove of particular value in subtropical and other regions requiring certain standards of hurricane or severe weather resistance for exterior doors and panels.

It is to be understood that the present invention is not limited to the sole embodiment described above, but encompasses any and all embodiments within the scope of the following claims.

I claim:

1. A three point lock mechanism for a hinged panel, comprising:

a central deadbolt lock set having a rotary shaft with a rotational axis, and driving a central jamb deadbolt;

an actuator plate having a center affixed to said rotary shaft of said deadbolt lock set, with said actuator plate including an upper and a lower deadbolt actuating rod attachment point, wherein said upper deadbolt actuating rod attachment point is farther from said center of said actuating plate than said lower deadbolt actuating rod attachment point, for providing a larger moment arm for said upper deadbolt actuating rod than for said lower deadbolt actuating rod;

an upper deadbolt actuating rod and a lower deadbolt actuating rod, each having a plate connecting end pivotally affixed to said upper and said lower deadbolt actuating rod attachment point of said actuator plate;

an upper deadbolt and a lower deadbolt, with said upper and said lower deadbolt each including a pivotal deadbolt actuating arm; and said upper and said lower deadbolt actuating rod each having a distal end respectively connected to said actuating arm of said upper and said lower deadbolt.

2. The three point lock mechanism according to claim 1, wherein said upper and said lower deadbolt actuating rod attachment point of said actuator plate are arcuately separated by substantially 135 degrees about said actuator plate.

3. The three point lock mechanism according to claim 2, wherein said lock set and said actuator plate have an unlocked position with said upper deadbolt actuating rod attachment point of said actuator plate being generally centered above said rotary shaft of said central deadbolt lock set and devoid of lateral moment, arid with said lower deadbolt actuating rod attachment point of said actuator plate being below and laterally offset from said rotary shaft of said rotary shaft for producing a net moment urging said lock set, said actuator plate, and said upper and said lower deadbolt to an unlocked position.

4. The three point lock mechanism according to claim 2, wherein said lock set and said actuator plate have a locked position with said upper deadbolt actuating rod attachment point of said actuator plate being offset generally laterally from said rotary shaft of said central deadbolt lock set for producing a large lateral moment, and with said lower deadbolt actuating rod attachment point of said actuator plate being above and laterally offset from said rotary shaft of said rotary shaft for producing a small lateral moment opposite said large lateral moment of said upper deadbolt actuating rod, with each said moment combining to produce a net moment urging said lock set, said actuator plate, and said upper and said lower deadbolt to a locked position.

5. The three point lock mechanism according to claim 1, wherein said upper and said lower deadbolt actuating rod each have equal linear actuation distances to one another.

6. The three point lock mechanism according to claim 1, wherein said actuator plate has a circular configuration and includes arcuate lock set structure clearance slots formed therethrough.

7. The three point lock mechanism according to claim 1, including length adjustment means disposed at said distal end of each said deadbolt actuating rod.

8. The three point lock mechanism according to claim 1, including an upper and a lower deadbolt housing respectively for said upper and said lower deadbolt, with each said deadbolt passing through a respective said housing.

9. The three point lock mechanism according to claim 1, wherein said actuator plate is non-magnetic, corrosion resistant steel.

10. A lockable panel including a three point lock mechanism, comprising in combination:

a hinged panel having an upper edge, an opposite lower edge, a hinge attachment edge, and a jamb edge;

a central deadbolt lock set installed within said panel and adjacent said jamb edge thereof, with said lock set having a rotary shaft with a rotational axis, and driving a central jamb deadbolt;

an actuator plate having a center affixed to said rotary shaft of said deadbolt lock set, with said actuator plate including an upper and a lower deadbolt actuating rod attachment point, wherein said upper deadbolt actuating rod attachment point is farther from said center of said actuating plate than said lower deadbolt actuating rod attachment point, for providing a larger moment arm for said upper deadbolt actuating rod than for said lower deadbolt actuating rod;

an upper deadbolt actuating rod and a lower deadbolt actuating rod, each having a plate connecting end pivotally affixed to said upper and said lower deadbolt actuating rod attachment point of said actuator plate;

an upper deadbolt and a lower deadbolt installed within said panel and respectively adjacent said upper edge and said lower edge thereof, with said upper and said lower deadbolt each including a pivotal deadbolt actuating arm; and said upper and said lower deadbolt actuating rod each having a distal end respectively connected to said actuating arm of said upper and said lower deadbolt.

11. The lockable panel and three point lock mechanism combination according to claim 10, wherein said upper and said lower deadbolt actuating rod attachment point of said actuator plate are arcuately separated by substantially 135 degrees about said actuator plate.

12. The lockable panel and three point lock mechanism combination according to claim 11, wherein said lock set and said actuator plate have an unlocked position with said upper deadbolt actuating rod attachment point of said actuator plate being generally centered above said rotary shaft of said central deadbolt lock set and devoid of lateral moment, and with said lower deadbolt actuating rod attachment point of said actuator plate being below and laterally offset from said rotary shaft of said rotary shaft for producing a net moment urging said lock set, said actuator plate, and said upper and said lower deadbolt to an unlocked position.

13. The lockable panel and three point lock mechanism combination according to claim 11, wherein said lock set and said actuator plate have a locked position with said upper deadbolt actuating rod attachment point of said actuator plate being offset generally laterally from said rotary shaft of said central deadbolt lock set for producing a large lateral moment, and with said lower deadbolt actuating rod attachment point of said actuator plate being above and laterally offset from said rotary shaft of said rotary shaft for producing a small lateral moment opposite said large lateral moment of said upper deadbolt actuating rod, with each said moment combining to produce a net moment urging said lock set, said actuator plate, and said upper and said lower deadbolt to a locked position.

14. The lockable panel and three point lock mechanism combination according to claim 10, wherein said upper and said lower deadbolt actuating rod each have equal linear actuation distances to one another.

15. The lockable panel and three point lock mechanism combination according to claim 10, wherein said actuator plate has a circular configuration and includes arcuate lock set structure clearance slots formed therethrough.

16. The lockable panel and three point lock mechanism combination according to claim 10, including length adjustment means disposed at said distal end of each said deadbolt actuating rod.

17. The lockable panel and three point lock mechanism combination according to claim 10, including an upper and a lower deadbolt housing respectively for said upper and said lower deadbolt, with each said deadbolt passing through a respective said housing.

18. The lockable panel and three point lock mechanism combination according to claim 10, wherein said actuator plate is non-magnetic corrosion resistant steel.

* * * * *